US005316120A

United States Patent [19]

Ibarrola

[11] Patent Number: 5,316,120

[45] Date of Patent: May 31, 1994

[54] HOUSING FOR COIN SELECTORS

[75] Inventor: Jesus E. Ibarrola, Pamplona, Spain

[73] Assignee: Azkoyen Industrial, S.A., Peralta, Spain

[21] Appl. No.: 855,024

[22] PCT Filed: Sep. 4, 1991

[86] PCT No.: PCT/ES91/00054

§ 371 Date: Jun. 19, 1992

§ 102(e) Date: Jun. 19, 1992

[87] PCT Pub. No.: WO92/04355

PCT Pub. Date: Mar. 19, 1992

[30] Foreign Application Priority Data

Sep. 5, 1990 [ES] Spain ..... 9002665[U]

[51] Int. Cl.[5] ..... G07D 5/08

[52] U.S. Cl. ..... 194/318; 194/345

[58] Field of Search ..... 194/317, 318, 335, 344, 194/345, 348; 193/DIG. 1

[56] References Cited

FOREIGN PATENT DOCUMENTS

| | | | |
|---|---|---|---|
| 0052043 | 5/1982 | European Pat. Off. . | |
| 2116236 | 10/1972 | Fed. Rep. of Germany . | |
| 2401471 | 3/1979 | France . | |
| 2474207 | 7/1981 | France . | |
| 2-144689 | 6/1990 | Japan | 194/348 |

*Primary Examiner*—F. J. Bartuska

*Attorney, Agent, or Firm*—Helegott & Karas

[57] ABSTRACT

The present housing for coin selectors is provided with an electronic circuit wherein are included elements for measuring the variation of the field produced by the passage of coins through a magnetic field generated by a group of coils, said housing being provided, on one of its faces (9) corresponding to the paths of coins, with various ribs (10) parallel to each other and parallel with the rolling ramp for the coins, preferably three ribs, with self-cleaning effect which avoids the deposition of dirt entrained by the coins.

1 Claim, 1 Drawing Sheet

HOUSING FOR COIN SELECTORS

BACKGROUND OF THE INVENTION

The present invention relates to a housing for coin selectors, specifically for selectors with electromagnetic coils which generate a magnetic field which is modified by the coins in its path, as a function of the intrinsic characteristics of each coin; or with selectors having sensors of an optical type. This housing has been perfected in order to avoid the classical problems arising from dirt deposited by the passing coins.

One of the most advanced and effective solutions in the area of coin selectors consists of using an electronic circuit in the pathway of coins which is capable of measuring the fluctuations in the magnetic field caused by the coins. This field is generated by a series of coils, such that with the collaboration of a series of standard measurements, the device is capable of selecting different types of coins, not only by their dimensions but also by the nature of the material from which the coins are made.

To this end, the housing of the selector is provided with a rolling ramp suitable for the passage of coins and designed to carry out the pertinent measurements. More specifically, the housing is provided with two sections joined to one another in a tilted manner, which reach their limiting positions through the use of a spring. One of these sections incorporates the electronic circuit cited above, and the other incorporates the electromagnetic coils or optical sensors, as the case may be, with a "laminar" space defined between the two, which is closed on its lower side by a thin, oblique wall belonging to one of the two sections and which determines the above-cited coin rolling ramp, and which is obviously parallel to the imaginary alignment line of the coils.

Moreover, the coins, because of their constant circulation and change of ownership, are often dirty. This dirt gradually accumulates on the areas of the housing that enter into contact with the coins, specifically on those areas of the housing where the vital elements of the housing are located, that is, on the measurement zone.

This accumulation of dirt on the coin pathways brings with it the fundamental problem of having to periodically and frequently clean the selector; otherwise, the selector will reject the coins.

SUMMARY OF THE INVENTION

The housing proposed by the invention has been conceived to fully resolve this problem. For this reason, its characteristics are centered on the fact that the sector which contains the electronic circuit, and more specifically that area which pertains to the location of the measurement elements, incorporates lengthwise ribs which run parallel to the trajectory of the coin on the coin rolling ramp; these ribs provide a self-cleaning effect and prevent the accumulation of dirt and grime in this area. This cleanliness is of vital importance for achieving a good measurement.

BRIEF DESCRIPTION OF THE DRAWINGS

As a complement to the description being made and for the purpose of contributing to a better understanding of the characteristics of the invention, a single sheet of figures is attached to this specification. These figures are merely illustrative and not limiting, and represent the following.

DETAILED DESCRIPTION OF THE PREFERRED EMBODIMENT

Figure 1:
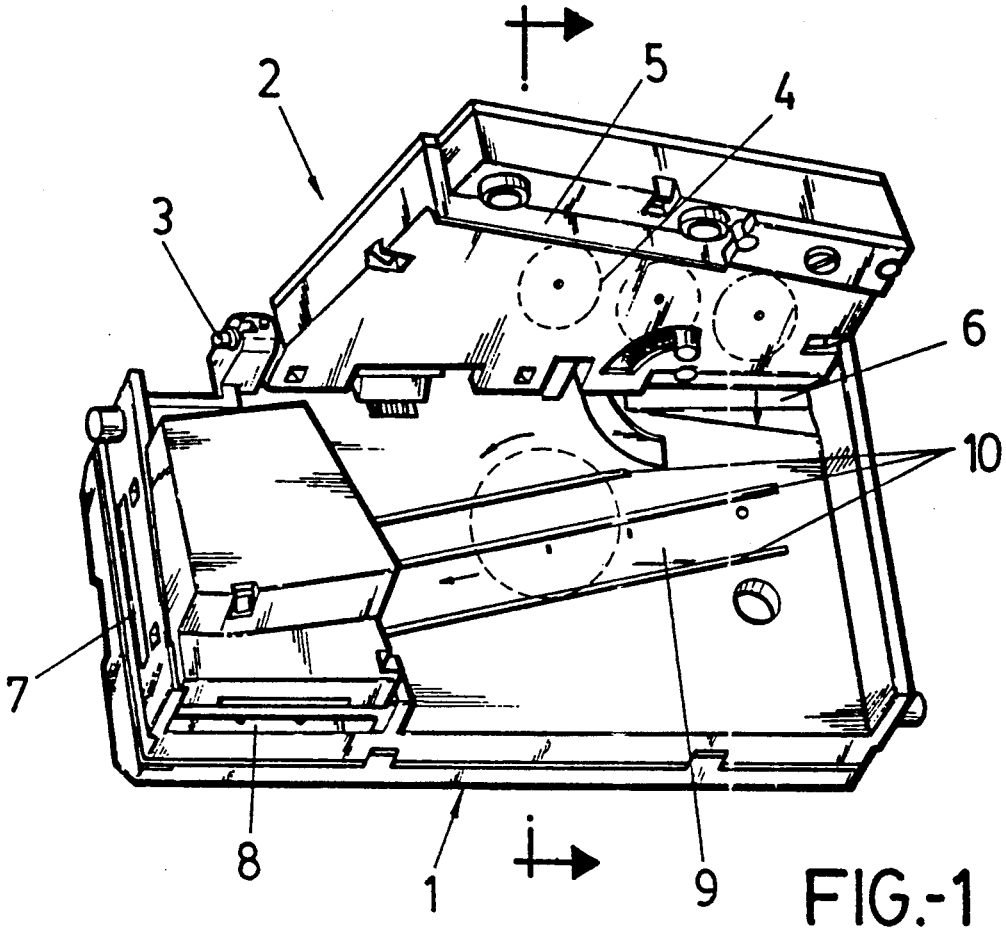
FIG. 1 is a perspective view of a coin selector having a housing constructed in accordance with the objective of the present invention, in which its two sectors appear open, against the pressure of the spring connecting them.
Figure 2:
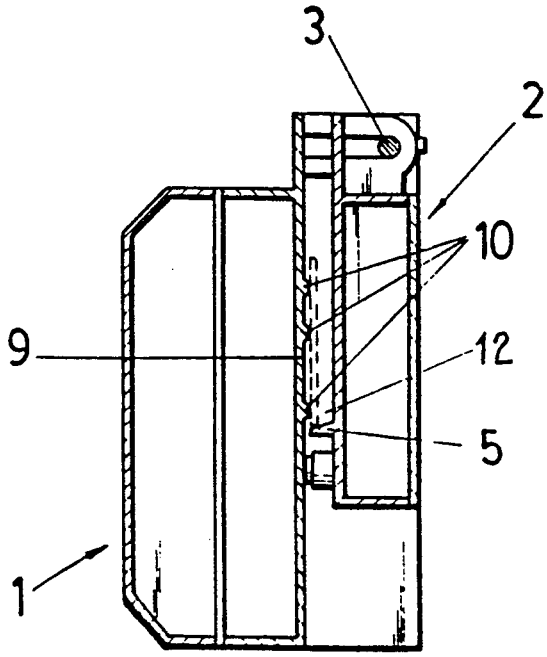
FIG. 2 is a transverse section view of the housing of FIG. 1 in a closed mode.

The housing for the coin selectors according to this invention is structured on the basis of two sections (1) and (2), joined to one another by an axis (3) which permits the tilting of one section with respect to the other against the tension of a spring (not represented in the figures). The section (1) of the housing houses the electronic control or selection circuit with its corresponding magnetic field variation sensors; section (2) contains the coils (4), represented by a dotted line in FIG. 1. These coils generate the magnetic field which is to be modified by the coins passing through its pathway.

As is also usual, there exists between these sections (1) and (2) of the housing, an inclined surface or rolling ramp for the coins, consisting of a thin wall (5) emerging from one of the two housing sections. This thin wall (5) closes the level chamber (12) defined by sections (1) and (2) at its lower end, from the coin entrance groove (6) to the exit groove (7) of same, with a detour (8) for the rejection of false or defective coins.

The invention is centered on the fact that section (1) of the housing, specifically in zone (9) located immediately above channeling the rolling ramp and specifically that pertaining to the zone where the elements of measurement of the electronic circuit are located, includes several lengthwise ribs or projections (10), which number three as shown in the figures of the practical example, but whose number may vary without this variation affecting the essence of the invention. These ribs or projections running parallel to the trajectory of the coins create a self-cleaning effect, preventing the buildup of dirt in the vital zone of the apparatus, that is, in the measurement zone (9) cited above. This allows for a considerable lengthening of the periods between maintenance for the selector.

It is not considered necessary to make this description more extensive for any expert on the subject to understand the reach of the invention and the advantages deriving from it.

The materials, form, size, and arrangement of the elements shall be subject to variation, as long as this does not involve an alteration of the essence of the invention.

The terms in which this report is described must always be taken in their broad, and not their limiting, senses.

I claim:

1. A coin selector housing comprising a first section and a second section hingedly connected to each other and defining therebetween a coin receiving chamber when said first and second sections are in a closed position, said first section including a coin entrance slot at one side thereof and coin exit slots at another side thereof, said first section accommodating an electronic control circuit having sensors, said second section accommodating electromagnetic coils for generating electromagnetic fields which are varied in response to coins passing said coin receiving chamber and measured by said sensors, said second section including a wall which defines an inclined rolling ramp for coins passing from said entrance slot towards said exit slots when said first and second sections are in said closed position, said first section having a surface forming a wall of said coin receiving chamber, said surface including a plurality of spaced-apart, elongated, parallel ribs extending parallel to said rolling ramp and positioned in an area where said control circuit sensors are located to prevent a buildup of dirt carried by the coins passing said chamber, at said area.

* * * * *